US006622531B2

(12) United States Patent
Ren et al.

(10) Patent No.: US 6,622,531 B2
(45) Date of Patent: Sep. 23, 2003

(54) DRUM WASHING MACHINE WITH DRAW-OUT INNER SPIN BASKET

(75) Inventors: Fuyu Ren, Qingdao (CN); Da li Sun, Qingdao (CN)

(73) Assignees: Haier Group Corporation, Qingdao (CH); Haier Merloni (Qingdao) Washing Machine Co., Ltd., Qingdao (CH)

( * ) Notice: Subject to any disclaimer, the term of this patent is extended or adjusted under 35 U.S.C. 154(b) by 0 days.

(21) Appl. No.: 10/057,254

(22) Filed: Jan. 23, 2002

(65) Prior Publication Data

US 2002/0157430 A1 Oct. 31, 2002

(30) Foreign Application Priority Data

Apr. 30, 2000 (CN) ..... 01 1 14922 A
Aug. 11, 2001 (CN) ..... 01 1 27321 A

(51) Int. Cl.[7] ..... D06F 21/00

(52) U.S. Cl. ..... 68/140; 68/210; 34/236; 34/596; 34/601; 34/602; 34/603; 312/228

(58) Field of Search ..... 68/210, 3 R, 140; 34/236, 596, 601, 602, 603; 312/228

(56) References Cited

U.S. PATENT DOCUMENTS 2,106,619 A * 1/1938 Merrill ..... 68/3 R
2,654,386 A * 10/1953 Wotring ..... 312/228
2,793,444 A * 5/1957 Turner ..... 34/602
3,011,327 A * 12/1961 Brownell ..... 68/210
3,139,744 A * 7/1964 Van Astyne et al. ..... 68/210

* cited by examiner

*Primary Examiner*—Randy Gulakowski
(74) *Attorney, Agent, or Firm*—Knobbe, Martens, Olson & Bear, LLP

(57) ABSTRACT

A drum washing machine with a draw-out inner spin basket is disclosed. The inner spin basket is spigotted movably on a driving shaft through a driving hole in the back plate of the inner spin basket. An axle of the spin basket is provided at a front plate of the inner spin basket. An end of the axle is inserted in a bearing. A cover is disposed in front of a front plate of the inner spin basket. The inner spin basket is rotatably attached to the cover through the axle of the spin basket and the bearing. A slide connection is disposed in a housing in a manner so that the inner spin basket can be drawn into or out of the housing. Since the inner spin basket can be drawn out of the housing in the drum washing machine, the laundry can be put or taken in outside of the housing.

38 Claims, 5 Drawing Sheets

DRUM WASHING MACHINE WITH DRAW-OUT INNER SPIN BASKET

RELATED APPLICATIONS

This application claims the benefit of the Chinese applications 01114922.1 filed Apr. 30, 2001 and 01127321.6 filed Aug. 11, 2001.

1. Technical Field

The invention relates to a drum washing machine, and more particularly to a drum washing machine with inner spin basket that could be drawn out of the housing.

2. Background Art

A drum washing machine is a new type of washing machine, which mainly consists of housing, an outer tub, an inner spin basket, draining devices and driving devices for the inner spin basket. The position of the laundry in the inner spin basket is adjusted by the forward and backward driving forces caused by driving devices under the control of the orders from the keyboard, thus improving the efficiency of the washing machine. But the drum washing machine in prior art just provides a window in one side of the housing for putting and taking the laundry. It is inconvenient for the user to bend his knees to put the laundry into the inner spin basket. As a result, a drum washing machine is expected whose the inner spin basket can be drawn out of the housing to put and take the laundry. In order to achieve the above object, the problem on how to draw the inner spin basket out of housing and ensure the seal between the inner spin basket and the outer tub must be solved.

DISCLOSURE OF THE INVENTION

An object of the present invention is to provide a drum washing machine with draw-out inner spin basket that could be drawn out of the housing to put and take the laundry.

To achieve the aforementioned object, the present invention provides a drum washing machine with draw-out inner spin basket, which comprises housing, an outer tub, an inner spin basket, draining devices and driving devices for the inner spin basket, wherein:

A. The inner spin basket 3 is spigotted movably on the driving shaft 4 by the driving hole in the back plate of the inner spin basket.

B. An axle 7 of the spin basket is provided at the front plate of the inner spin basket 3. An end of the axle 7 is inserted in the bearing 9.

C. A cover 8 is disposed in front of the front plate of the inner spin basket 3. Said bearing 9 is positioned in the bearing box 21 inside the cover 8. The inner spin basket 3 is rotatably attached to the cover 8 through the axle 7 of spin basket and the bearing 9.

D. A on-off door 22 of the inner spin basket is formed of the opening on the side wall of the inner spin basket 3.

E. A seal ring 11 is mounted around the front circumference of the outer tub 2. The inner circumference of the cover 8 forms a sealing surface corresponding to the seal ring 11, which is pressed against the sealing ring 11 to form sealing therebetween so that the cover 8 is attached to the front circumference end of the outer tub 2.

F. Slide connection 10 is disposed between the inner wall of the housing 1 or the back plate of the outer tub 2 and the inner spin basket 3 so that the inner spin basket 3 can be drawn into or out of the housing 1.

According to a Drum washing machine of the present invention, the inner spin basket 3 can be drawn into or out of the housing 1 by means of the slide connection 10. The door 22 on the side wall of the inner spin basket 3 can be opened to put and take the laundry instead of the window in prior art.

Additionally, in the present invention, the cover 8 is disposed such that it is attached to the front circumference end of outer tub 2 to form sealing therebetween by means of the seal ring 11.

The driving shaft 4 is driven by a driving device not shown in the figures so that the inner spin basket 3 is rotated around the axis of the axle 7 of the spin basket and driving shaft 4 inside the outer tub 2.

In the present invention, the driving shaft 4 is supported on the bearing mounted in the fixing mount 13, which is fixed on the outside of the back plate of the outer tub 2. The driving shaft 4 is constituted of an axle 14, a flange 15 and studs 16 circularly distributed on the end face of the flange 15.

According to the present invention, the driving shaft 4 is constituted of the axle 14, the flange 15 and studs 16. The axle 14 of the driving shaft 4 is supported on the bearing mounted in the fixing mount 13 so that the driving shaft 4 can be rotated freely with respect to the outer tub 2.

In the present invention, the driving holes at the back plate of the inner spin basket 3 are designed to be corresponding to the studs 16. Each of the studs 16 is inserted into the corresponding driving hole so that the inner spin basket 3 can be spigotted movably onto the driving shaft 4.

In the present invention, Each of the studs 16 is inserted into the corresponding driving hole at the back plate of the inner spin basket 3 so that the inner spin basket 3 can be rotated synchronistically with the driving shaft 4.

Additionally, the number of the studs 16 and the driving holes which are distributed uniformly along the circumference of flange 15 is preferably more than 2, such as 3, 4, 5 or 6. The number of studs 16 need not be equal to the number of the driving holes. For example, the number of the driving holes can be designed as 4 or 6, and the studs 16 may be designed correspondingly as 2 or 3. It is easy to connect the inner spin basket 3 with the driving shaft 4 by inserting the stud 16 into the driving hole.

In the present invention, the slide connection 10 is formed of at least two guide supports 5 and guide 6 which is mounted in the guide supports 5. The guide supports 5 are respectively mounted on the side wall of the housing 1 which is opposite to the side wall of the inner spin basket 3. The front end of the guide 6 is connected with the connecting bar 10 fastened on the cover 8. The guide 6 slides in the guide support 5 so that the inner spin basket 3 can be drawn out of and put in the housing 1.

In the present invention, the slide connection 10 is constituted of the guide supports 5 and the guides 6 which slide along the guide supports 5 so that the inner spin basket 3 can be drawn into or out of the housing 1. The two guide supports 5 can be respectively disposed in the side wall of the housing 1 along the rotation axis of spin basket 3 in parallel to each other. The guides 6 are disposed correspondingly and respectively on the side wall of the inner spin basket 3 and fastened at the opposite ends of the connecting bar 20 on the cover 8.

Additionally, if balls 17 are provided in the guide supports 5, the guides 6 slide in the guide supports 5 through the balls 17 so that the inner spin basket 3 can be drawn out or pushed in more easily.

In the present invention, the slide connection 10 is constituted of at least one guide bar 23 and outer conduit 24 which is disposed to slide on the outside surface of the guide bar 23. One end of the guide bar 23 is fixed on the outer circumference of flange 15 on the driving shaft 4 which is connected with the outer tub 2. The other end of the guide bar 23 is inserted into the inner spin basket 3. One end of the outer conduit 24 is spigotted and slide on the end of the guide bar 23 which is inserted into the inner spin basket 3. The other end of the outer conduit 24 is fixed on the corresponding outer circumference of the flange 15 in the front of the inner spin basket 3. By the sliding of the outer conduit 24 along the guide bar 23, the inner spin basket 3 can be drawn out of or pushed into the housing 1.

In another embodiment of the invention, the slide connection 10, which is similar to the antenna, is constituted of the guide bar 23 and the outer conduit 24. Drawing the outer conduit 24 can draw the spin basket 3 out of the housing 1. The slide connection 10 is compact since it is positioned inside the inner spin basket 3 and on the flange 15 of the driving shaft 4 (independently of the housing 1).

Additionally, at least one inner conduit 25 can be inserted movably in the outer conduit 24, and the guide bar 23 is inserted in and slide along the inner conduit 25. The guide bar 23, at least one inner conduit 25 and the outer conduit 24 are designed as step-shaped axle, and the draw distance of the outer conduit 24 out of the housing 1 becomes longer due to the inner conduit 25.

In the drum washing machine according to the invention, with one or more inner conduit 25, the inner spin basket 3 can be drawn out of the housing 1 for a long distance. The connect strength of the outer conduit 24 and the guide bar 23 also can be improved. One or two inner conduit 25 is enough to meet the needs of utilization.

In the drum washing machine according to the invention, the sealing surface 12 is a stainless steel plate that is inlayed in the inner face of the cover 8. The sealing line of the sealing surface 12 is a plane or inclined plane.

The seal ring 11 encloses the outer edge of the front circumference of the outer tub 2 and is locked by a locking collar 18 to fasten the cover 8 onto the outer tub 2.

According to the present invention, reliable seal between the cover 8 and the outer tub 2 can be provided.

Additionally, in the present invention, a door of the housing 19 can be provided in the front of the housing 1. When the washing machine operates after the door of the housing 19 has been closed, the noise can be decreased as much as possible. Also the machine is in good shape with the door. Of course, in place of the door 19, a round hole, which is a little larger than the outer diameter of the cover, can be provided at the position of the housing corresponding to the door to draw or push the inner spin basket, thus simplifying the structure of the washing machine.

At last, in the drum washing machine according to the invention, a handle 26 is provided in the front of cover 8. It is more convenient to draw or push the inner spin basket.

As above described, the present invention has the following advantages and effects compared with the prior art:

1. As the drum washing machine according to the invention is improved, the inner spin basket is movable axially to be drawn out of the housing. It is more convenient for the user to put or take the laundry with standing by the machine instead of bending his knees, so the inconvenience for the user to bend his knees to put and take the laundry is overcome.
2. As the reliable spigot structure between the inner spin basket and the driving shaft is provided, it is more convenient to draw or push the inner spin basket.
3. As the guide support is provided with balls, it is easier to draw or push the inner spin basket with accurate guide, less friction and soundless.
4. The slide connection is constituted of the guide bar and the outer conduit, so it is compact and also convenient for the users to draw or push the inner spin basket.
5. The inner spin basket is supported on two bearings in the opposite ends respectively, so it operates stably in high speed.

BRIEF DESCRIPTION OF THE DRAWINGS

A preferred embodiment of the invention will now be described by way of examples and with reference to the accompanying drawings, in which.

In the accompanying drawings.

Figure 1:
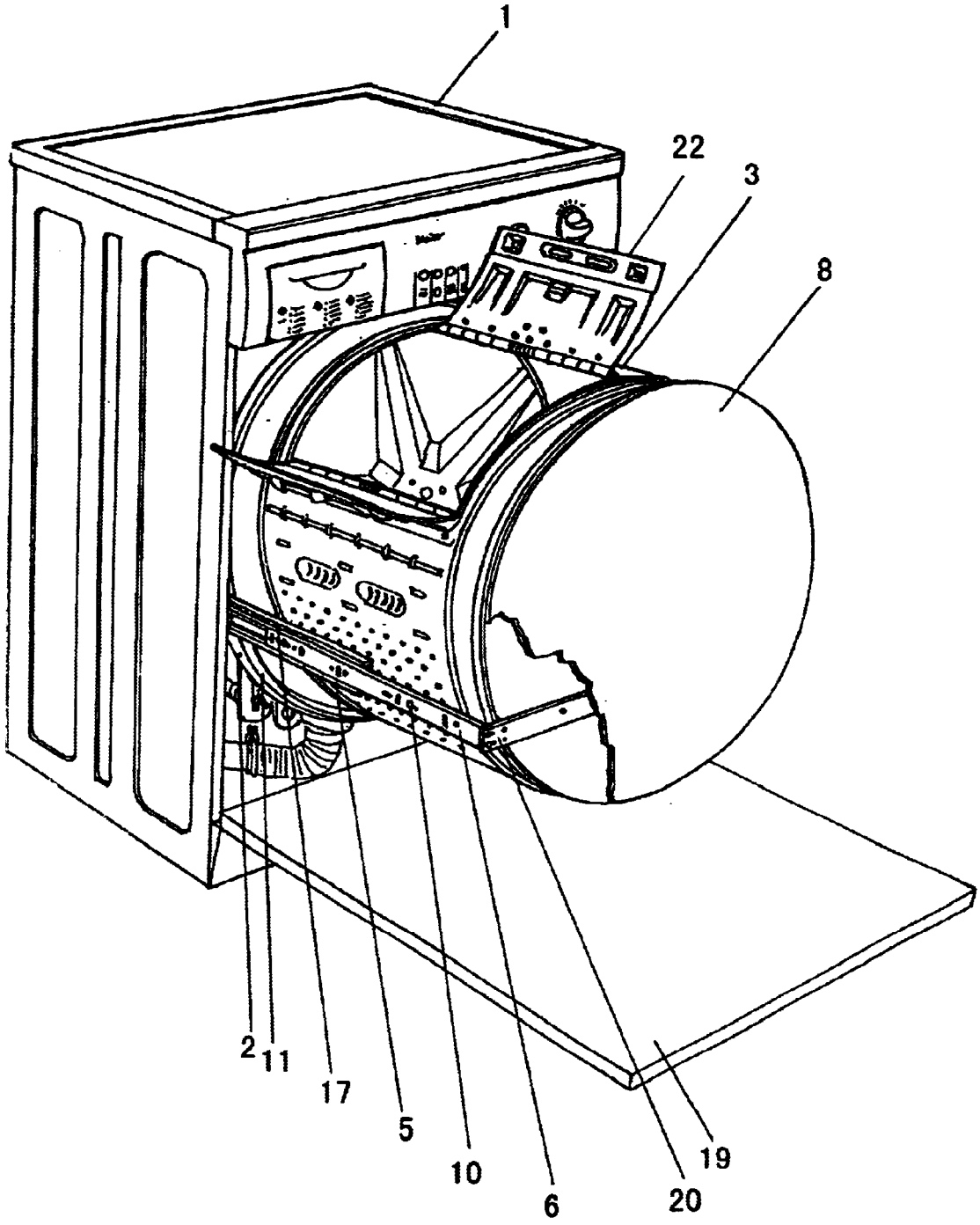
FIG. 1 is a perspective view of the drum washing machine in accordance with a first preferred embodiment of the invention in which the inner spin basket is drawn out of the housing.

Within housing 1; outer tub 2; inner spin basket 3; driving shaft 4; guide support 5; guide 6; axle of the spin basket 7; cover 8; bearing 9; slide connection 10; seal ring 11; sealing surface 12; fixing mount 13; axle 14; flange 15; stud 16; ball 17; locking collar 18; door of the housing 19; connecting bar 20; bearing box 21; door of the spin basket 22; guide bar 23; outer conduit 24; inner conduit 25; handle 26.

EMBODIMENT OF THE INVENTION

A first preferred embodiment of the present invention will be described referring to FIG. 1, FIG. 2, FIG. 4 and FIG. 5.

Figure 2:
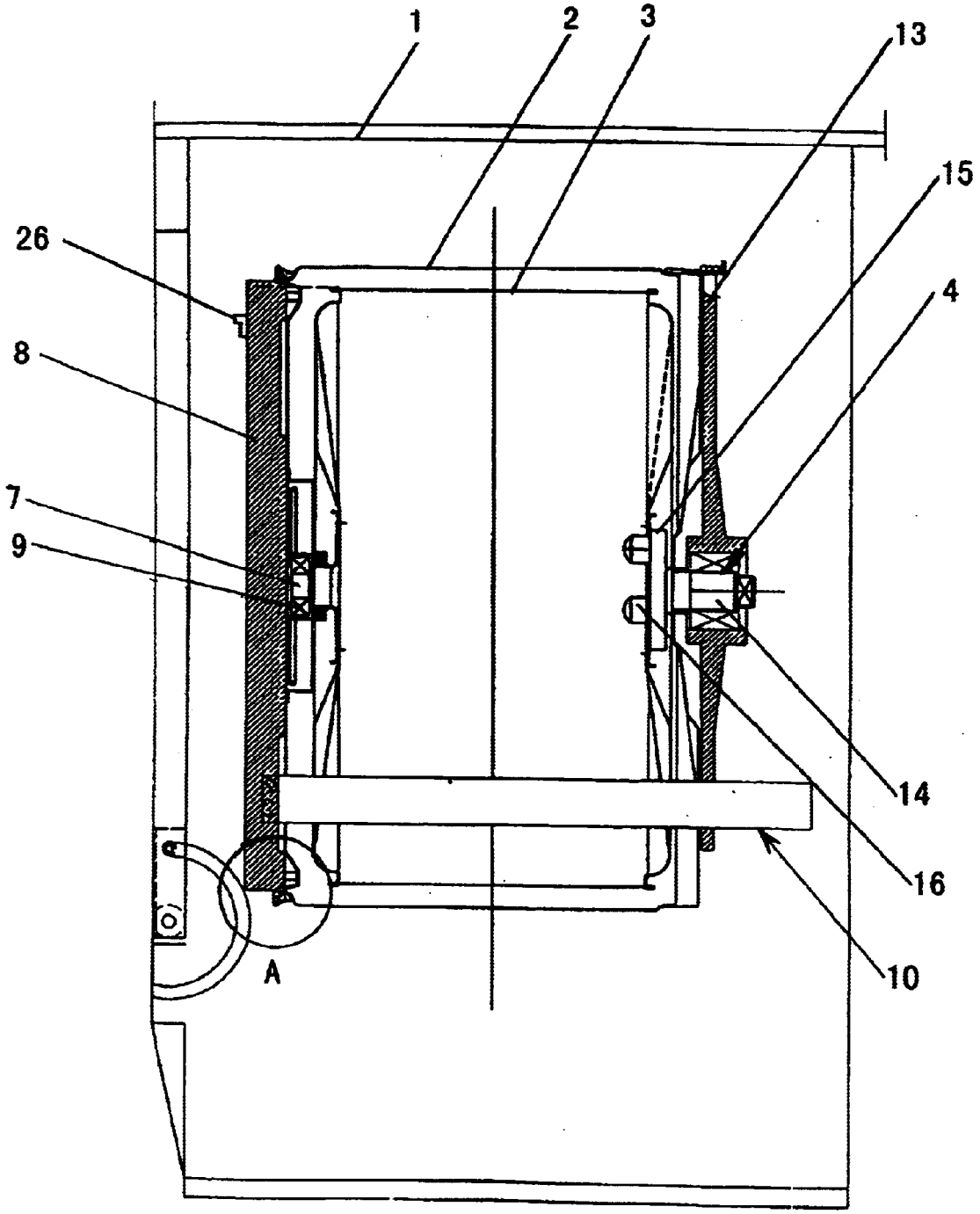
FIG. 2 is a sectional view of the drum washing machine in accordance with a first preferred embodiment of the present invention.

As shown in FIGS. 1 and 2, the drum washing machine with drawout inner spin basket in the present invention mainly consists of a housing 1, an outer tub 2, an inner spin basket 3, draining devices (not illustrated) and driving devices for the inner spin basket. Slide connection 10 is disposed between the housing 1 and the cover 8 of the inner spin basket 3. A door of the inner spin basket 22 is formed on the side wall of the inner spin basket 3. FIG. 1 is a perspective view of the drum washing machine in which the inner spin basket is drawn out of the housing and the door 22 is opened. In order to draw the inner spin basket 3 out of the housing transversely, the inner spin basket 3 is spigotted movably on the driving shaft 4 through the driving hole (6 holes in total) in the back plate of the inner spin basket. The driving shaft 4 is positioned on a fixing mount 13 which is fixed on the outside of the back plate of the outer tub 2. The driving shaft 4 is constituted of an axle 14, a flange 15 and three studs 16 circularly distributed on the end face of the flange 15 (spaced angle is 120° with each other) which is distributed roundly in flange 15. Three of the six holes can be spliced into the three studs 16 by adjusting slightly. In order to draw out the inner spin basket and to provide sealing, a cover 8 is disposed in front of the inner spin basket 3 to which the cover 8 is connected. A seal ring 11 is mounted around the circumference of the front of the outer tub 2 and is locked by a locking collar 18. The inner circumference of the cover 8 forms a sealing surface 12 sealed with the seal ring 11. When washing, the sealing surface 12 is pressed tightly against the seal ring 11 to provide sealing therebetween for ensuring watertightness. An axle 7 of the spin basket is provided at the front plate of the inner spin basket 3. An end of the axle is inserted in the bearing 9 that is positioned in inner side of cover 8. The inner spin basket 3 is supported on the front bearing 9 and rear bearing for supporting the driving shaft 4 to rotate around their axis. A handle 26 is formed in the front of the cover 8, which can be used to draw or push the inner spin basket 3. Two guide supports 5 with balls 17 are fastened on the inner side of the housing 1. The front end of guide 6, which is spliced in the guide support 5, is joined to a connecting bar 20 for fastening the cover 8. When the inner spin basket 3 is drawn or pushed, it can move back and forth along with the guide 6 in convenience and labor saving. The door 19 is optionally formed on the housing 1 or not.

When the machine is running, the inner spin basket 3 stays inside space of the outer tub 2. The cover 8 is pressed against the outer tub 2 tightly so as to provide sealing therebetween. The inner spin basket 3 rotates around the axis formed of the axle 7 of the spin basket in the front and the driving shaft 4 at the back. When washing has finished, the handle 26 is held to draw out, so the inner spin basket 3 can be drawn out through the cover 8. The engaging holes in the inner spin basket 3 get away from the studs of the driving shaft 4 so that the inner spin basket 3 is drawn out of the housing along the guide supports 5. It is more convenient for the users to take the laundry with standing by the inner spin basket 3. After the laundry has been taken out, then the inner spin basket is pushed into the inside space of the outer tub 2 by pushing the cover 8 inside. Three of the six engaging holes in the inner spin basket are engaged with the three studs of the driving shaft 4 so that the inner spin basket 3 returns the initial position.

Figure 3:
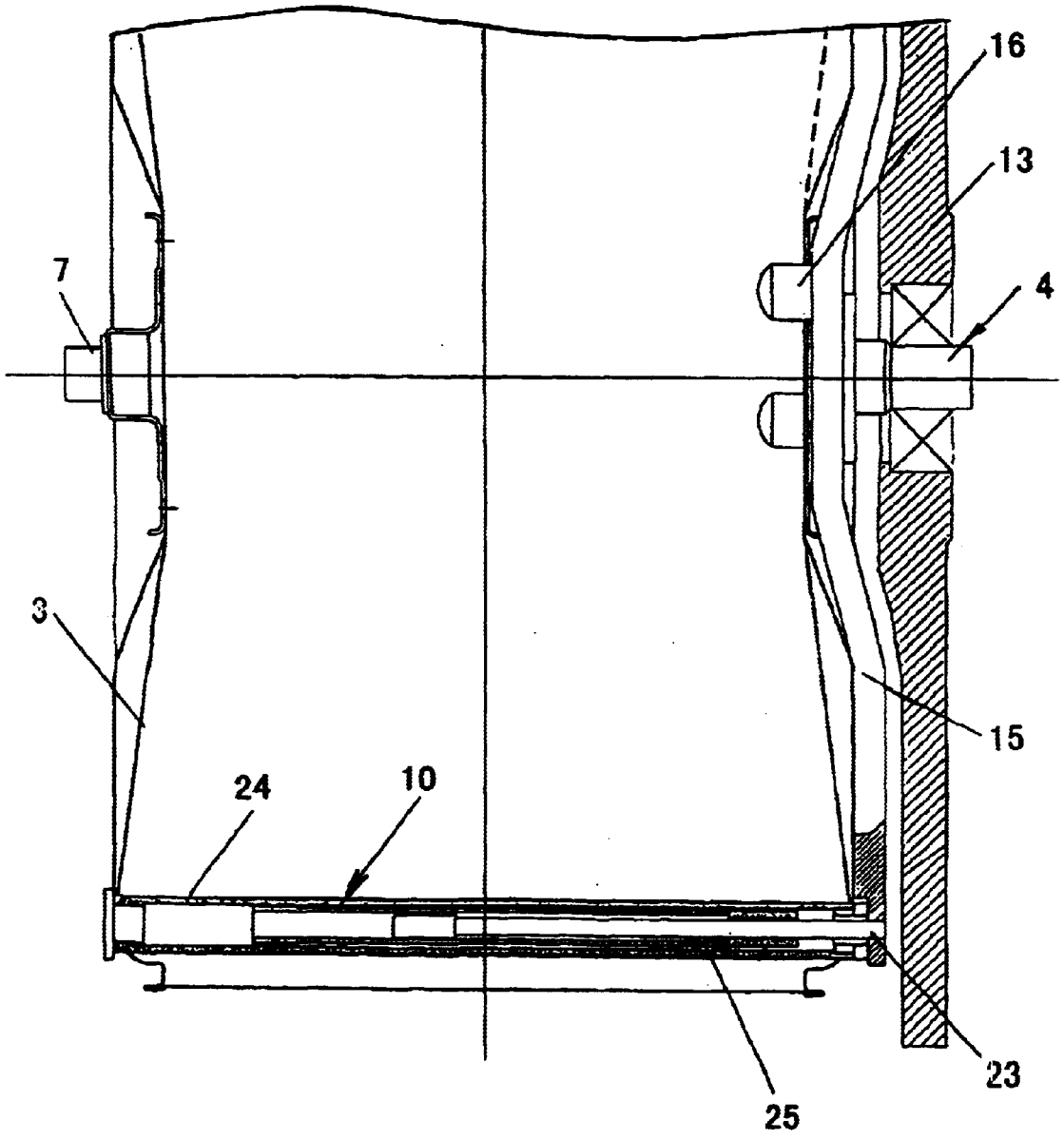
FIG. 3 is a partial sectional view of the slide connection of the drum washing machine in accordance with a second preferred embodiment of the present invention.
Figure 4:
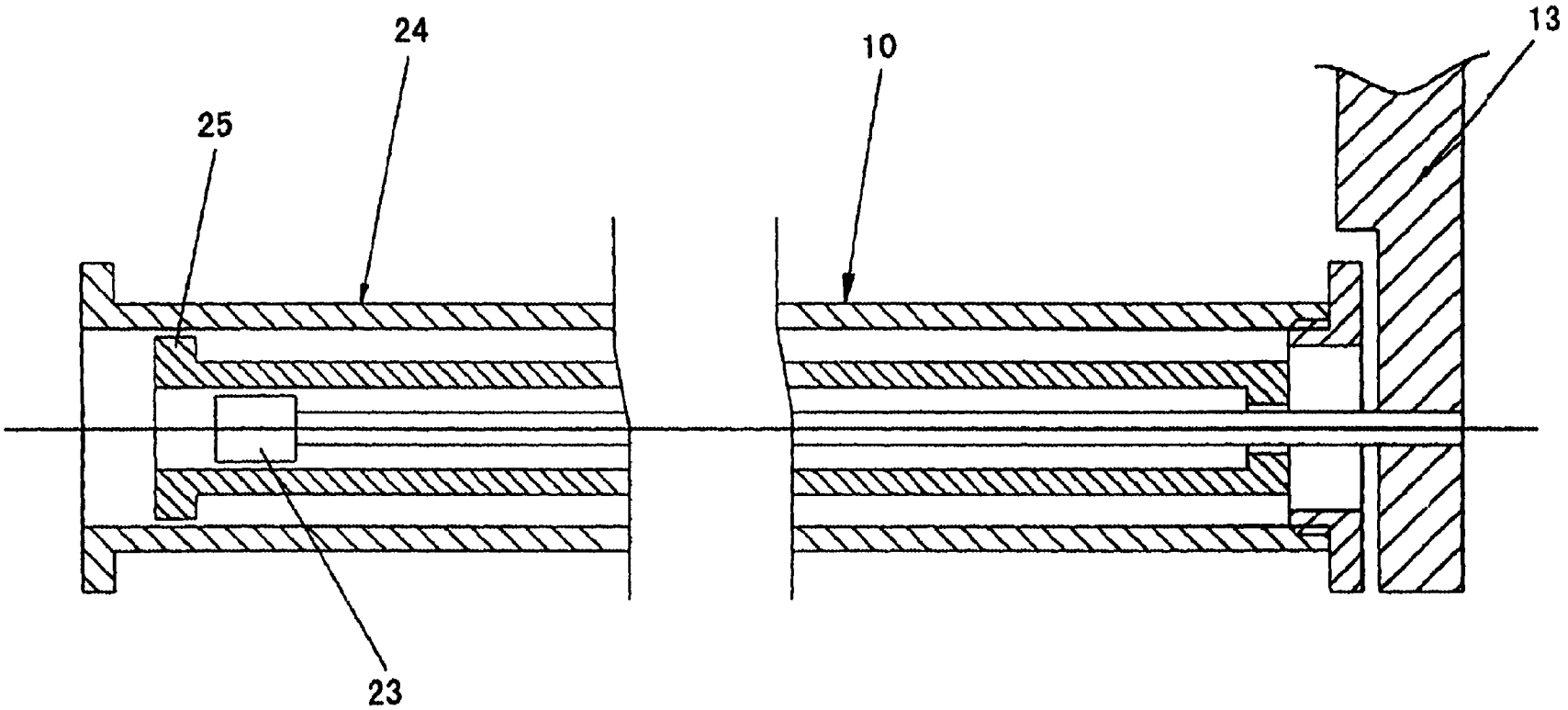
FIG. 4 is an enlarged sectional view of the slide connection of the drum washing machine in accordance with a second preferred embodiment of the present invention.
Figure 5:
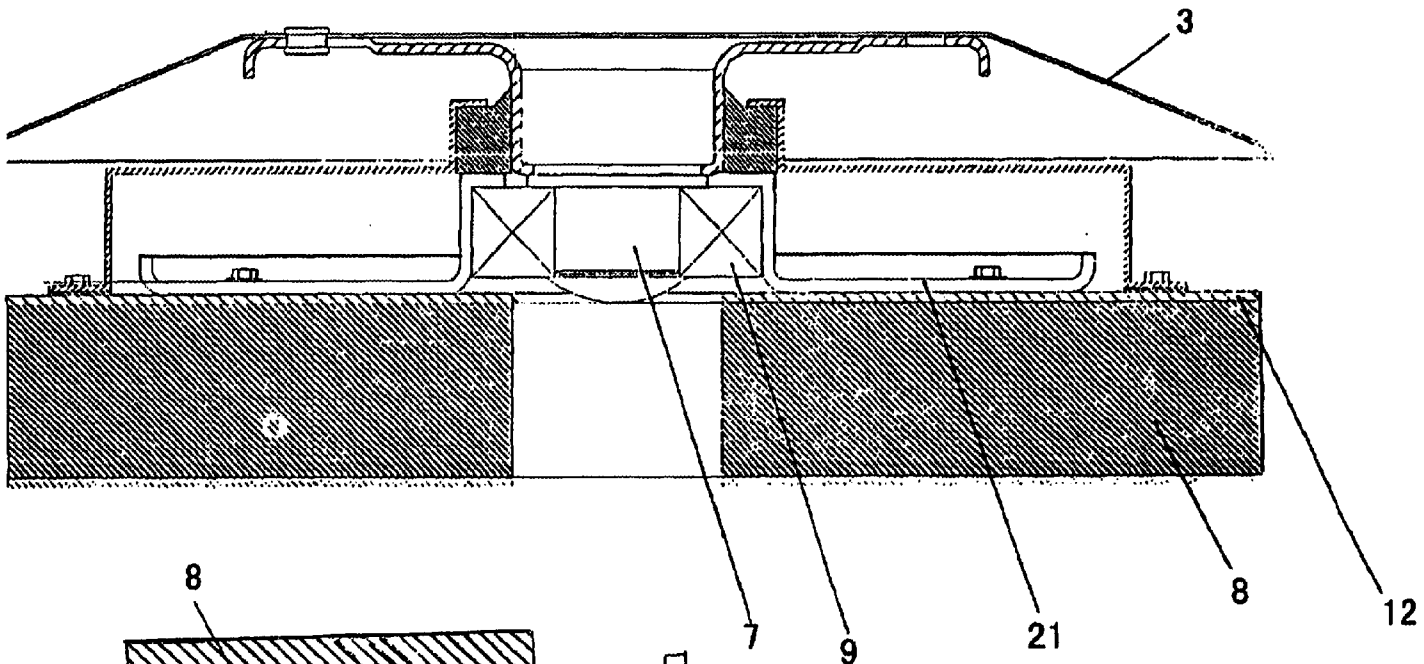
FIG. 5 is a partial sectional view showing the connection of the inner spin basket and the cover in the drum washing machine according to the invention.
Figure 6:
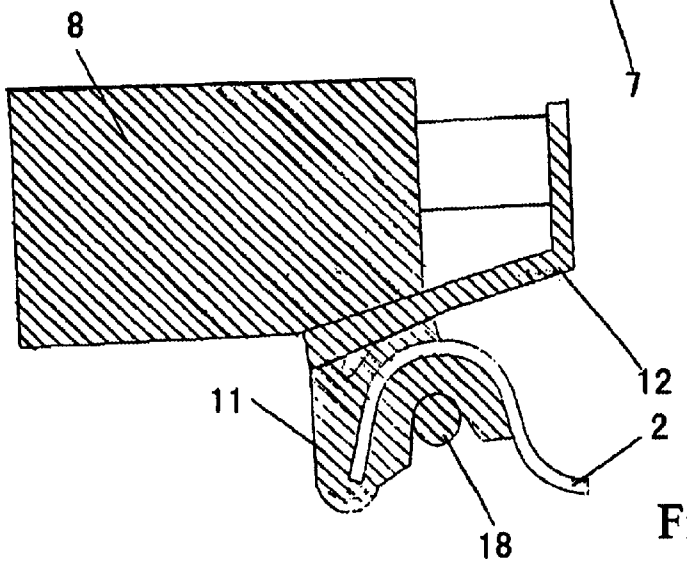
FIG. 6 is a partial sectional view showing the sealing between the cover and the outer tub (As shown in part A in FIG. 2).

FIGS. 3 and 4 show the slide connection of the drum washing machine in accordance with a second preferred embodiment of the present invention. The drum washing machine with a drawout inner spin basket in accordance with the second preferred embodiment of the invention is the same as that in accordance with the first preferred embodiment other than the slide connection 10. So the following description only relates to the structure and operation process of slide connection 10 of the drum washing machine in accordance with the second preferred embodiment.

As shown in FIGS. 3 and 4, since the structure of the slide connection 10 is designed to be similar to the antenna, the inner spin basket 3 is in alignment with the flange 15 of the driving shaft 4 during drawing and pushing so that it can accurately and reliably be engaged and disengaged with the flange to ensure being drawn out of the housing entirely. A guide bar 23 is fixed transversely in the end surface of the flange 15 and transversely inserted in the inner spin basket 3. An outer conduit 24 is fixed at the corresponding position in the inner spin basket 3. A fastening plug is positioned at the back end of the outer conduit 24. An inner conduit 25 is inserted movably in the outer conduit 9. A disc is mounted at the front end of the inner conduit 25. The inner diameter of the fastening plug is larger than the outer diameter of the inner conduit 25 and smaller than the outer diameter of the disc. The guide bar 23 is inserted in the inner conduit 25. The front end of the guide bar 23 forms a step-shaped shaft with a larger front portion and a smaller rear portion. In the rear end of the inner conduit 25, an aperture is formed whose inner diameter is larger than or equal to the diameter of the smaller portion of the guide bar 23 and smaller than the diameter of the larger portion of the guide bar 23. A pin is disposed at the other end opposite to the end of flange for fixing guide bar 23, which is inserted in the corresponding hole in the inner spin basket 3. A strengthening plate is mounted in the middle of the back outside wall of the inner spin basket 3 to strengthen the strength of the back plate of the inner spin basket 3.

When the inner spin basket 3 will be drawn out through the cover 8, the holes in the inner spin basket 3 is disengaged with the corresponding stud 16. The outer conduit 24 mounted on the inner spin basket 3 is drawn out along the inner conduit 23, since the inner diameter of the fastening plug is larger than the outer diameter of the inner conduit 23. When the outer conduit 24 is drawn to reach the position of the disc at the front end of the inner conduit 25, the disc stops the fastening plug and the inner conduit 25 continues to be drawn out. At this moment, the guide bar 23 guides the inner conduit 25. When the aperture at the back of the inner conduit 25 is drawn to reach the position of the front larger portion of the guide bar 23, the inner conduit 25 is stopped. With the two successive processes, the distance, which the inner spin basket 3 is drawn out, is larger than the width of the inner spin basket, so it is sure that the inner spin basket could be drawn out of the housing.

With the guidance of the slide connection, the engaging holes of the inner spin basket 3 is always in alignment with the corresponding studs of the flange during drawing out the inner spin basket 3. The inner spin basket 3 returns in position easily, because it is easy that the engaging holes are engaged with the corresponding studs 16 during the returning.

As above described, in the drum washing machine with a drawout inner spin basket according to the invention, the inner spin basket can be drawn out of housing easily as the slide connection, the cover and seal are designed in the machine. So it is more convenient to use the drum washing machine according to the invention than that in the prior art.

What is claimed is:

1. A drum washing machine device comprising:

an outer tub having a first back plate, a circumference, a front circumference, and front circumference end;

an inner spin basket having a front plate, a second back plate, a side wall, and an axle, wherein the inner spin basket is slidably engaged on a driving shaft through a driving hole in the second back plate, and wherein the axle is provided at the front plate, and wherein an end of the axle is inserted in a bearing;

a cover having a bearing box and an inner circumference, wherein the cover is positioned in front of the front plate, and wherein the bearing is positioned in a bearing box inside the cover, and wherein the inner spin basket is rotatably attached to the cover through the axle and the bearing;

a door that is positioned adjacent an opening on the side wall;

a sealing ring that is mounted around the circumference of a front of the outer tub, and wherein the inner circumference of the cover forms a sealing surface corresponding to the sealing ring, which is pressed against the sealing ring to form a seal therebetween so that the cover is attached to the front circumference end of the outer tub; and a slide connection that is disposed between an inner wall of a housing on the first back plate of the outer tub and second back plate of the inner spin basket so that the inner spin basket can be drawn into or out of the housing.

2. The device of claim 1, wherein the outer tub further comprises a fixing mount that is fixed on an outside of the back plate of the outer tub, wherein the driving shaft is supported on the bearing mounted in the fixing mount, and wherein the driving shaft comprises a second axle and a flange having an end face, and wherein the driving shaft further comprises studs, which are circularly distributed on the end face of the flange.

3. The device of claim 2, wherein the inner spin basket comprises a plurality of driving holes in the back plate corresponding to the studs in a manner such that each of the studs is insertable into a corresponding driving hole so that the inner spin basket can be slidably engaged onto the driving shaft.

4. The device of claim 3, wherein the slide connection is formed of at least two guide supports and a guide, which is mounted in the guide supports, such that the at least two guide supports are respectively mounted on a side wall of the housing, which is opposite to the side wall of the inner spin basket, and wherein a front end of the guide is connected with a connecting bar fastened on the cover, and wherein the guide slides in the at least two guide supports so that the inner spin basket can be drawn into and out of the housing.

5. The device of claim 4, wherein the at least two glide supports comprise balls, and wherein the guides slide in the guide supports through the balls.

6. The device of claim 5, wherein the slide connection comprises at least one guide bar and an outer conduit, which is disposed to slide on the outside surface of the guide bar, and wherein a first end of the guide bar is fixed on an outer circumference of the flange on the driving shaft, which is connected with the outer tub, and a second end is inserted into the inner spin basket, and wherein a first end of the outer conduit is slidably engaged to slide on the first end of the guide bar, which is inserted into the inner spin basket, and wherein a second end of the outer conduit is fixed on an outer circumference of the flange in the front of the inner spin basket, and wherein, by sliding the outer conduit along the guide bar, the inner spin basket can be drawn out of or pushed into the housing.

7. The device of claim 6, wherein at least one inner conduit can be inserted movably in the outer conduit, and wherein the guide bar is inserted in and slides along the inner conduit, and wherein the guide bar, the at least one inner conduit, and the outer conduit are designed as a step-shaped axle, and wherein a draw distance of the outer conduit out of the housing becomes longer due to the inner conduit.

8. The device of claim 1, wherein the cover further comprises an inner face, and wherein the sealing surface is a stainless steel plate that is inlayed in the inner face of the cover, and wherein a sealing line of the sealing surface is a plane or inclined plane.

9. The device of claim 1, wherein the sealing ring encloses an outer edge of the front circumference of the outer tub and is locked by a locking collar that fastens the cover onto the outer tub.

10. The device of claim 1, wherein the housing comprises a door that is positioned in front of the housing.

11. The device of claim 1, wherein a handle is positioned adjacent a front of the cover.

12. A drum washing machine device comprising:

an outer tub positioned within the drum washing machine device, wherein the outer tub comprises a housing and a first back plate;

an inner spin basket positioned within the outer tub, wherein the inner spin basket comprises a first axle and is slidably engaged on a driving shaft;

a cover:

a sealing ring that is mounted adjacent the outer tub, wherein the cover forms a sealing surface when pressed against the sealing ring to form a seal therebetween; and a slide connection that is disposed between the housing of the outer tub and the inner spin basket so that the inner spin basket can be drawn into or out of the housing.

13. The device of claim 12, wherein the inner spin basket comprises a front plate, a second back plate, and a side wall, wherein the inner spin basket is slidably engaged on the driving shaft through a driving hole in the second back plate, and wherein the first axle is provided at the front plate, and wherein an end of the first axle is inserted in a bearing.

14. The device of claim 13, wherein the cover comprises a bearing box and an inner circumference, wherein the cover is positioned in front of the front plate, and wherein the bearing is positioned in the bearing box inside the cover, and wherein the inner spin basket is rotatably attached to the cover through the first axle and the bearing.

15. The device of claim 14, wherein the inner spin basket is rotatably attached to the cover via the first axle.

16. The device of claim 15, further comprising a door that is positioned adjacent an opening on the side wall of the inner spin basket.

17. The device of claim 16, wherein the sealing ring is mounted around the circumference of a front of the outer tub, and wherein the inner circumference of the cover forms the sealing surface when pressed against the sealing ring to form a seal therebetween so that the cover is attached to a front circumference end of the outer tub.

18. The device of claim 12, wherein the slide connection is disposed between an inner wall of a housing on the first back plate of the outer tub and the second back plate of the inner spin basket so that the inner spin basket can be drawn into or out of the housing.

19. The device of claim 18, wherein the outer tub further comprises a fixing mount that is fixed on an outside of the first back plate of the outer tub, wherein the driving shaft is supported on the bearing mounted in the fixing mount.

20. The device of claim 12, wherein the driving shaft comprises a second axle and a flange having an end face.

21. The device of claim 20, wherein the driving shaft further comprises studs, which are circularly distributed on the end face of the flange.

22. The device of claim 21, wherein the inner spin basket further comprises a plurality of driving holes positioned adjacent the second back plate in a manner corresponding to the studs such that each of the studs is inserted into a corresponding driving hole so that the inner spin basket can be slidably engaged onto the driving shaft.

23. The device of claim 22, wherein the slide connection comprises at least one guide and at least one guide support.

24. The device of claim 23, wherein the at least one guide is mounted in the at least one guide support.

25. The device of claim 24, comprising at least two guide supports wherein the at least one of the guide supports is mounted on a side wall of the housing, which is opposite to the side wall of the inner spin basket, and wherein a front end of the guide is connected with a connecting bar fastened on the cover, and wherein the guide slides in the at least two guide supports so that the inner spin basket can be drawn into and out of the housing.

26. The device of claim 25, wherein the at least one of the glide supports comprises balls, and wherein the guides slide in the guide supports through the balls.

27. The device of claim 26, wherein the slide connection further comprises at least one guide bar and an outer conduit, which is disposed to slide on the outside surface of the guide bar.

28. The device of claim 27, wherein a first end of the guide bar is fixed on an outer circumference of the flange on the driving shaft, which is connected with the outer tub, and a second end of the guide bar is inserted into the inner spin basket.

29. The device of claim 28, wherein a first end of the outer conduit is slidably engaged to slide on the first end of the guide bar, which is inserted into the inner spin basket, and wherein a second end of the outer conduit is fixed on an outer circumference of the flange in the front of the inner spin basket.

30. The device of claim 29, wherein the inner spin basket can be drawn out of or pushed into the housing by sliding the outer conduit along the guide bar.

31. The device of claim 30, wherein at least one inner conduit can be inserted movably in the outer conduit.

32. The device of claim 31, wherein the guide bar is inserted in and slides along the inner conduit.

33. The device of claim 32, wherein the guide bar, the at least one inner conduit, and the outer conduit are designed as a step-shaped axle, and wherein a draw distance of the outer conduit out of the housing becomes longer due to the inner conduit.

34. The device of claim 12, wherein the cover further comprises an inner face, and wherein the sealing surface is a stainless steel plate that is inlayed in the inner face of the cover.

35. The device of claim 34, wherein a sealing line of the sealing surface is a plane or inclined plane.

36. The device of claim 35, wherein the sealing ring encloses an outer edge of a front circumference of the outer tub and is locked by a locking collar that fastens the cover onto the outer tub.

37. The device of claim 12, wherein the housing comprises a door that is positioned in front of the housing.

38. The device of claim 12, further comprising a handle, wherein the handle is positioned adjacent a front of the cover.

* * * * *